US008608524B2

(12) United States Patent
Jeong

(10) Patent No.: US 8,608,524 B2
(45) Date of Patent: Dec. 17, 2013

(54) WATER SHOE

(75) Inventor: Woon-Eik Jeong, Gyeonggi-do (KR)

(73) Assignee: Rainbow Scape Co., Ltd., Gyeonggi-do (KR)

( * ) Notice: Subject to any disclaimer, the term of this patent is extended or adjusted under 35 U.S.C. 154(b) by 264 days.

(21) Appl. No.: 13/161,586

(22) Filed: Jun. 16, 2011

(65) Prior Publication Data

US 2012/0100766 A1 Apr. 26, 2012

(30) Foreign Application Priority Data

Oct. 21, 2010 (KR) ..... 10-2010-0102783
May 2, 2011 (KR) ..... 10-2011-0041373
May 2, 2011 (KR) ..... 10-2011-0041374

(51) Int. Cl.
*B63B 35/83* (2006.01)

(52) U.S. Cl.
USPC ..... 441/76

(58) Field of Classification Search
USPC ..... 441/65, 76, 77, 78, 79, 55, 61–64
See application file for complete search history.

(56) References Cited

U.S. PATENT DOCUMENTS 1,476,905 A * 12/1923 Mardus ..... 441/76
2,651,790 A * 9/1953 Geiger ..... 441/76
4,801,284 A * 1/1989 Lieu ..... 441/76

FOREIGN PATENT DOCUMENTS

CN 201980393 U * 9/2011 ..... B63B 35/83
KR 10-0596913 6/2006
KR 20-0449402 6/2010

* cited by examiner

*Primary Examiner* — Daniel Venne
(74) *Attorney, Agent, or Firm* — Design IP

(57) ABSTRACT

Provided is a water shoe facilitating walking on a water surface. The water shoe of the present invention includes: a foot fixing portion to fix a foot; a supporting bar coupled with the foot fixing portion; a floating membrane foldable toward and unfoldable from the supporting bar with the supporting bar functioning as a pivot shaft to provide buoyancy to the water shoe when the floating membrane comes into contact with a water surface; and a folding hinge portion coupled with the floating membrane to fold and unfold the floating membrane. The water shoe of the present invention has a simple structure, and may be put to use in water leisure sports at an inexpensive cost. Further, the water shoe may be used even in a narrow area, without a motor boat, and almost unencumbered by weather conditions.

15 Claims, 8 Drawing Sheets

WATER SHOE

BACKGROUND OF THE INVENTION

1. Field of the Invention

The present invention relates to a water shoe, and more particularly, to a water shoe which facilitates walking on a water surface.

2. Description of the Related Art

With industrial development, the number of people enjoying leisure sports, including water sports such as wind surfing and water skiing, is increasing.

Wind surfing is to surf on water by using wind with a surfing board having a sail. Water skiing is to surf on water with skis worn by holding on to a rope connected to a motor boat.

With regard to wind surfing, a utility model titled MULTI-FUNCTIONAL SURF BOARD FOR LEISURE PURPOSES has been disclosed in Korean Utility Model No. 20-0449402. Also, with regard to water skiing, an invention titled MOTORLESS PORTABLE WATER SKI has been disclosed in Korean Patent No. 10-0596913.

However, wind surfing and water skiing not only require a lot of equipment costs but also take a lot of time and expenses to learn necessary skills, and the number of people who enjoy wind surfing and water skiing has been rather limited. Also, wind surfing and water skiing require a large water area and favorable weather conditions, and thus, are rather limited spatially and meteorologically.

SUMMARY OF THE INVENTION

Accordingly, the present invention is directed to provide a convenient water shoe for water leisure sports at an inexpensive cost that substantially obviates one or more problems due to limitations and disadvantages of the related art.

The present invention is also directed to provide a water shoe which may be used even in a narrow area and almost unencumbered by weather conditions.

The present invention is also directed to provide a water shoe which may facilitate walking on a water surface by decreasing an area of a floating membrane coming into contact with the water surface when the water shoe is lifted up.

The present invention is also directed to provide a water shoe which may prevent a foot from slipping in walking or veering on a water surface.

A water shoe of the present invention includes: a foot fixing portion to fix a foot; a supporting bar coupled with the foot fixing portion; a floating membrane foldable toward and unfoldable from the supporting bar with the supporting bar functioning as a pivot shaft to provide buoyancy to the water shoe when the floating membrane comes into contact with a water surface; and a folding hinge portion coupled with the floating membrane to fold and unfold the floating membrane.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
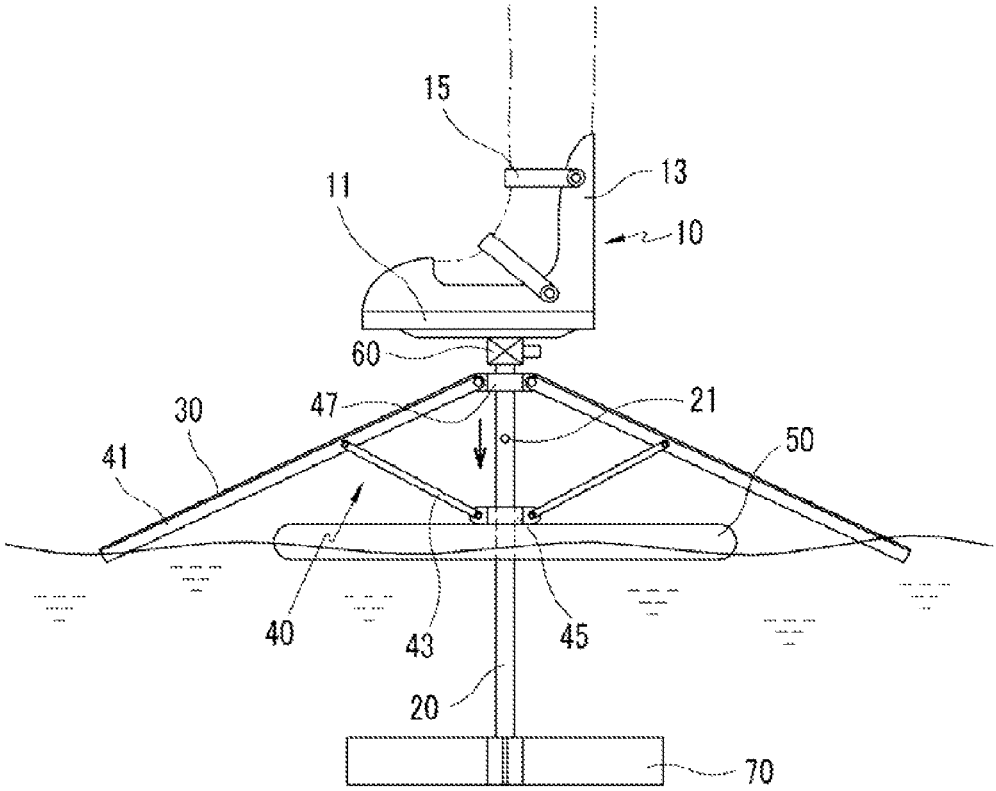
FIG. 1 is a cross-sectional view illustrating a water shoe according to an embodiment of the present invention.
Figure 2:
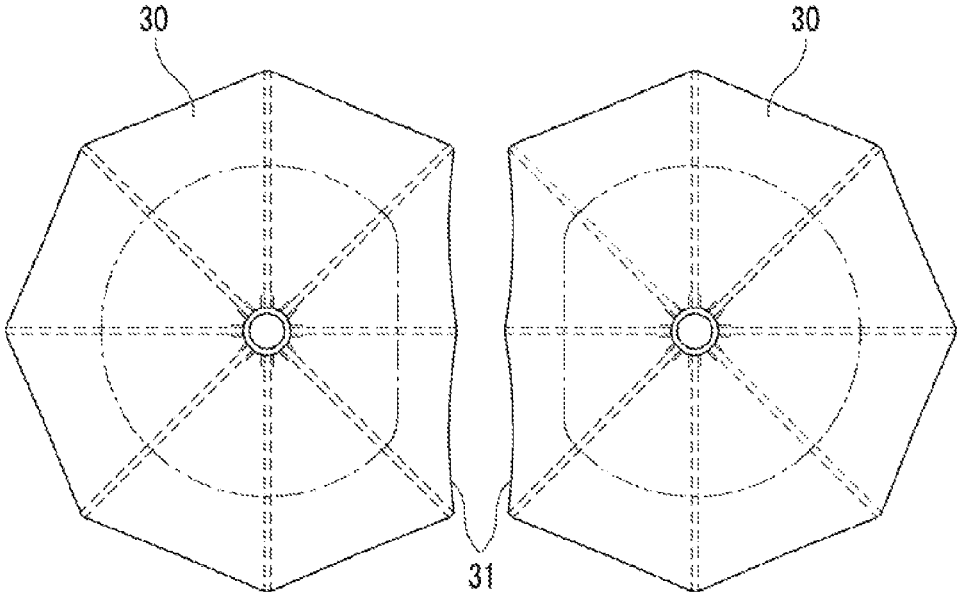
FIG. 2 is a plan view illustrating a floating membrane of the water shoe of FIG. 1.
Figure 3:
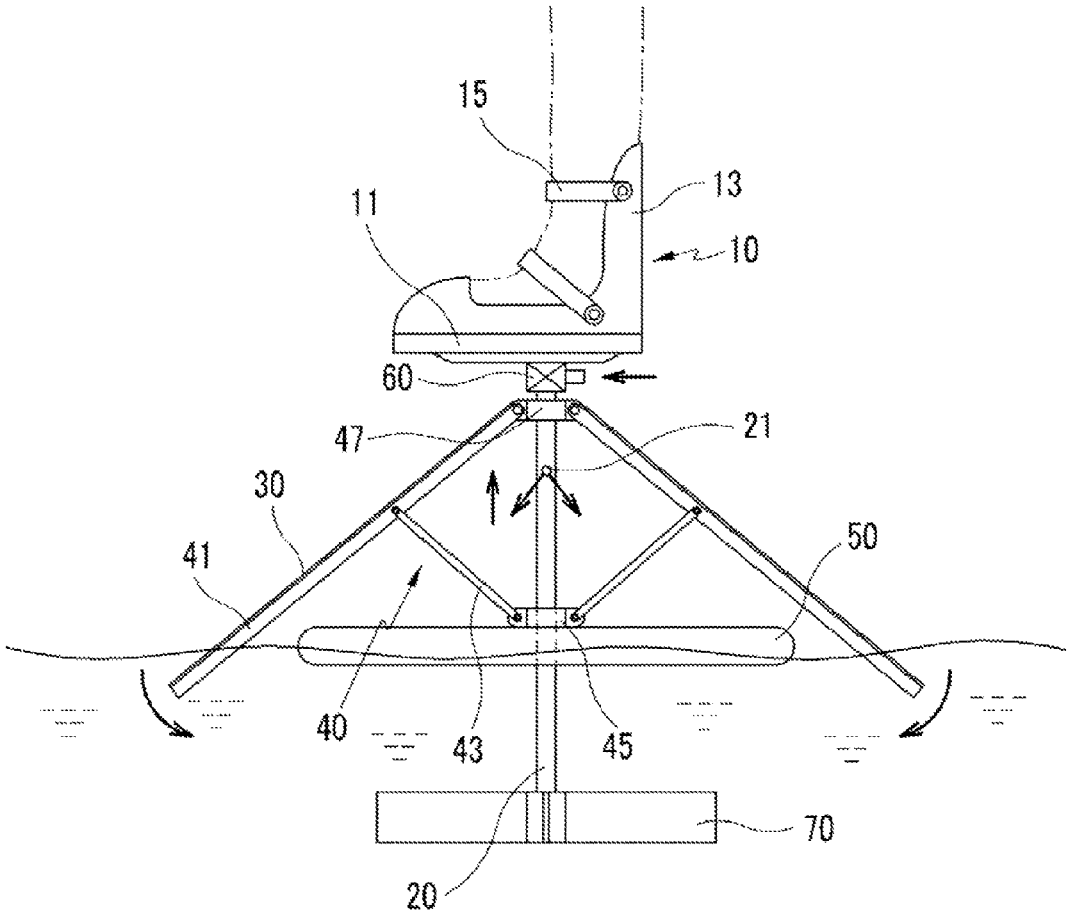
FIG. 3 is a cross-sectional view illustrating the water shoe of FIG. 1 being detached from a water surface.
Figure 4:
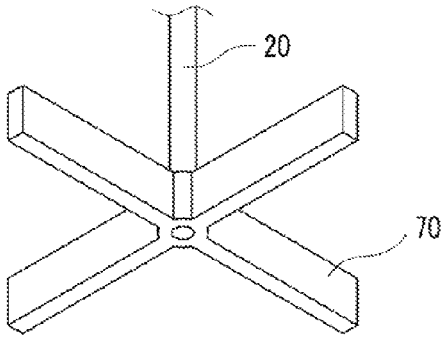
FIG. 4 is a perspective view illustrating a bottom surface of a non-slip portion of the water shoe of FIG. 1 through 3.

FIG. 1 is a cross-sectional view illustrating a water shoe according to an embodiment of the present invention, FIG. 2 is a plan view illustrating a floating membrane of the water shoe of FIG. 1, FIG. 3 is a cross-sectional view illustrating the water shoe of FIG. 1 being detached from a water surface, and FIG. 4 is a perspective view illustrating a bottom surface of a non-slip portion of the water shoe of FIG. 1 through 3.

The water shoe according to the current embodiment includes a foot fixing portion 10, a supporting bar 20, a floating membrane 30, a folding hinge portion 40, a float 50, a check valve 60, and a non-slip portion 70.

The foot fixing portion 10 includes a footplate 11 fixed to an upper end of the supporting bar 20 to support a sole of a shoe or a sole of a foot, a binder 13 fixed to an upper surface of the footplate 11 to support front and rear portions of a shoe or a foot, and a fastening band 15 fixed to the binder 13. Here, the fastening band 15 may fasten an ankle stably by being coupled with a turnbuckle or a hook. A structure of the foot fixing portion 10 may vary as long as the foot fixing portion 10 fixes a shoe or a foot stably.

The supporting bar 20 is coupled vertically with a lower portion of the foot fixing portion 10 to support the floating membrane 30 and the folding hinge portion 40. The supporting bar 20 has a pole shape or a polygonal bar shape so that an air passage may be formed in the supporting bar 20. An air passage (not illustrated) is formed in the supporting bar 20, and a vent hole 21 for ventilation is formed on a side surface of the supporting bar 20.

The floating membrane 30 is configured to provide buoyancy to the water shoe when the floating membrane 30 comes into contact with a water surface. The floating membrane 30 may be folded toward or unfolded from the supporting bar 20 with the supporting bar 20 functioning as a pivot shaft, and supported by the folding hinge portion 40. The floating membrane 30 may be formed of a material having a hydrophobic property or coated with a hydrophobic substance so that water may be removed from a surface of the floating membrane 30 with speed.

Here, a side 31 (an inner side of a leg when the water shoe is worn) of the floating membrane 30 may be cut as illustrated in FIG. 2. In other words, the floating membrane 30 has a dee shape, and legs do not need to be spread excessively when the water shoes are worn since a distance between the legs may be reduced substantially. In this case, walking on a water surface may become more convenient and stable than when the floating membrane 30 has a circular shape.

The folding hinge portion 40 is coupled with the floating membrane 30 to support the floating membrane 30 such that the floating membrane 30 may be folded or unfolded. The folding hinge portion 40 includes a plurality of floating membrane supporting members 41 coupled with a bottom surface of the floating membrane 30 to support the floating membrane 30, a plurality of supporting ribs 43 configured to support the floating membrane supporting members 41, and a slider 45 configured to support lower ends of the supporting ribs 43.

Here, upper ends of the floating membrane supporting members 41 are hinge-connected to a fixing unit 47 fixed to supporting bar 20. Upper ends of the supporting ribs 43 are hinge-connected to the floating membrane supporting members 41, and lower portions the lower ends of the supporting ribs 43 are hinge-connected to the slider 45. Here, the slider 45 is disposed at the supporting bar 20 in an elevatable manner. The floating membrane supporting members 41, the supporting ribs 43, the slider 45, and the fixing unit 47 have a three-bar link shape. The floating membrane supporting member 41 disposed at a side where the floating membrane 30 is cut may be shorter than any one of the rest of the floating membrane supporting members 41.

The float 50 is disposed at the supporting bar 20 to provide buoyancy to the water shoe along with the floating membrane 30. The float 50 is coupled with the slider 45 of the folding hinge portion 40, and moves upwards and downwards along with the slider 45. Here, a hole may be formed at a center of the float 50 so that the supporting bar 20 may be inserted through the hole.

The check valve 60 is disposed at the supporting bar to provide external air to a space between the floating membrane 30 and a water surface when the floating membrane 30 is folded. Here, the check valve 60 is disposed between the foot fixing portion 10 and the floating membrane 30. The check valve 60 may be disposed inside or outside the supporting bar 20.

The check valve 60 may provide external air to the space between the floating membrane 30 and a water surface through the vent hole 21 after the external air is sucked in. However, the check valve 60 prevents air between the floating membrane 30 and a water surface from flowing out. The check valve 60 allows the floating membrane 30 to be folded with ease by sucking external air into the space between the floating membrane 30 and a water surface when the floating membrane 30 is folded.

The non-slip portion 70 is fixed to a lower end of the supporting bar 20 to prevent a foot from slipping on a water surface. The non-slip portion 70 facilitates walking and veering on a water surface. The non-slip portion 70 may have a cross shape to maintain a balance effectively. However, the present invention is not limited thereto.

Hereinafter, operation of the water shoe of the current embodiment is described in detail.

Referring to FIG. 1, a foot is put in the foot fixing portion 10, and then the fastening band 15 is fastened. Here, the fastening band 15 allows the foot to be fixed stably to the binder 13.

After the water shoe is worn, the foot may be lifted up, and then put down. Then, a rim of the floating membrane 30 comes into contact with a water surface. Here, air in the space between the floating membrane 30 and the water surface is locked by the rim of the floating membrane 30 and the water surface, and only a part of the air flows out while the rest of the air stays locked in. Here, the check valve 60 prevents the air in the space between the floating membrane 30 and the water surface from flowing out through the air passage.

When a weight of the foot affects the water shoe, the floating membrane 30 is unfolded by a pressure in the space. When the floating membrane 30 is unfolded, the floating membrane supporting members 41 of the folding hinge portion 40 are unfolded in both directions, and the float 50 is moved upwards by the slider 45.

The more the water shoe is moved under the water surface, the more compressed the air between the floating membrane 30 and the water surface. Then, the space between the floating membrane 30 and the water surface contracts, and the pressure in the space increases substantially to become larger than atmospheric pressure.

The floating membrane 30, the space, and the float 50 provide buoyancy to the water shoe to keep the foot afloat. Here, the space between the floating membrane 30 and the water surface provides buoyancy to the floating membrane 30, and the float 50 provides buoyancy to the folding hinge portion 40.

Referring to FIG. 2, the side 31 of the floating membrane 30 is cut, and the water shoe may facilitate walking on a water surface conveniently with legs not spread excessively.

Referring to FIG. 3, when the foot is lifted up for walking, the floating membrane 30 is lifted up. In this case, the space between the floating membrane 30 and the water surface expands gradually, and the pressure in the space decreases gradually.

The more the water shoe is lifted up, the closer the pressure in the space to atmospheric pressure. In this case, the floating membrane 30 is about to be detached from the water surface.

When the pressure in the space between the floating membrane 30 and the water surface becomes lower than atmospheric pressure, air flows into the space through the check valve 60. Then, the floating membrane 30 and the folding hinge portion 40 are folded slightly because of the air flown into the space. In this case, the pressure in the space becomes almost the same as atmospheric pressure, and the floating membrane 30 may be detached with ease from the water surface.

As described above, the check valve 60 provides air to the space between the floating membrane 30 and the water surface only when the floating membrane 30 is folded, and prevents the floating membrane 30 from functioning as a resister when the foot is lifted up. Therefore, the check valve 60 facilitates walking on a water surface.

Meanwhile, as illustrated in FIGS. 1, 3, and 4, frictional force is generated by the non-slip portion 70 fixed to the lower end of the supporting bar 20 to prevent the foot from slipping during walking and veering on a water surface. Therefore, the water shoe may facilitate walking and veering on a water surface.

As described above, the water shoe of the current embodiment of the present invention has a simple structure, and may be put to use in water leisure sports at an inexpensive cost. Further, the water shoe may be used even in a narrow area, without a motor boat, and almost unencumbered by weather conditions. In addition, the water shoe of the current embodiment enables walking and veering without slipping on a water surface since the non-slip portion 70 is fixed to the lower end of the supporting bar 20.

Figure 5:
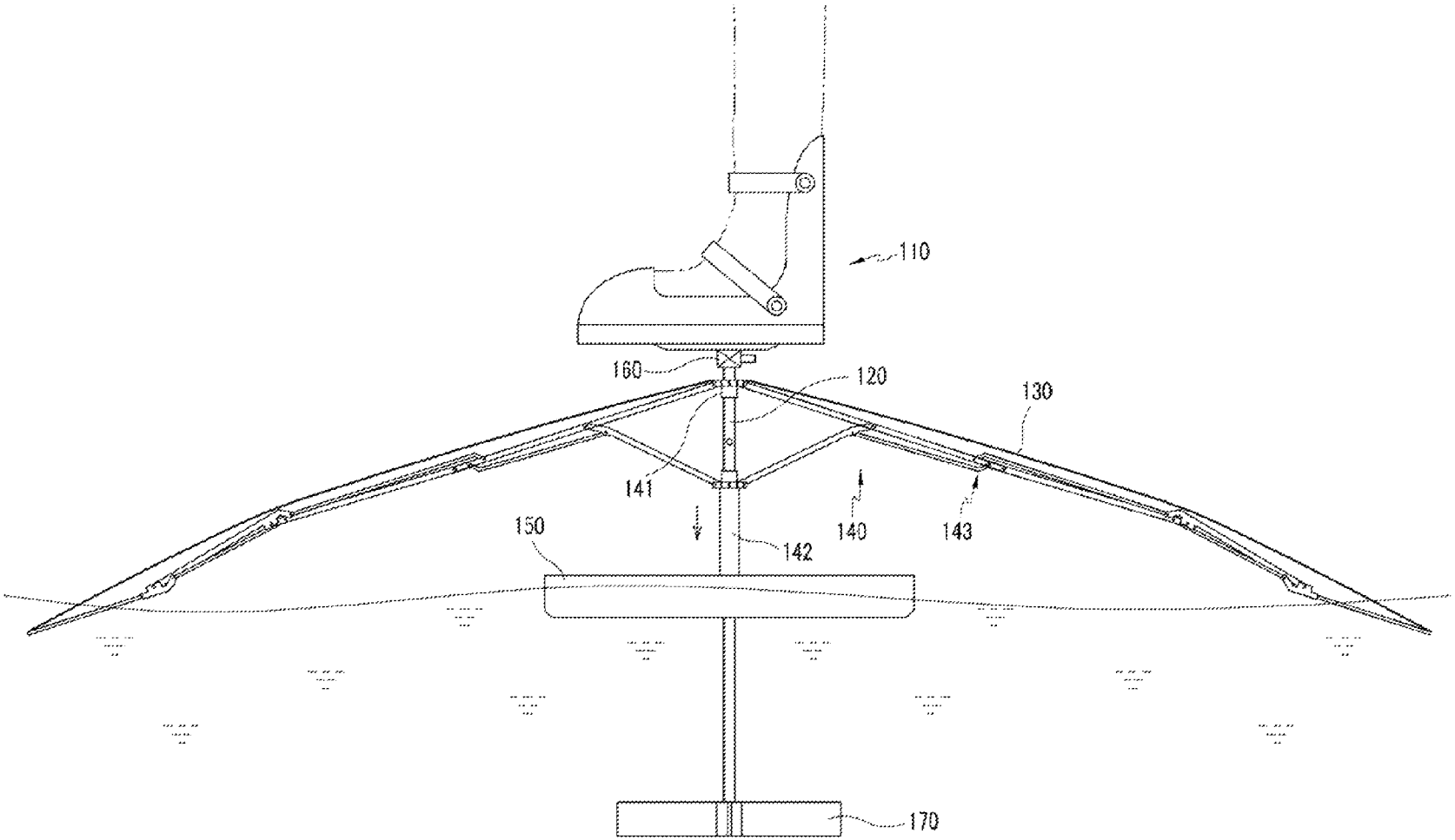
FIG. 5 is a cross-sectional view illustrating a water shoe according to another embodiment of the present invention.
Figure 6:
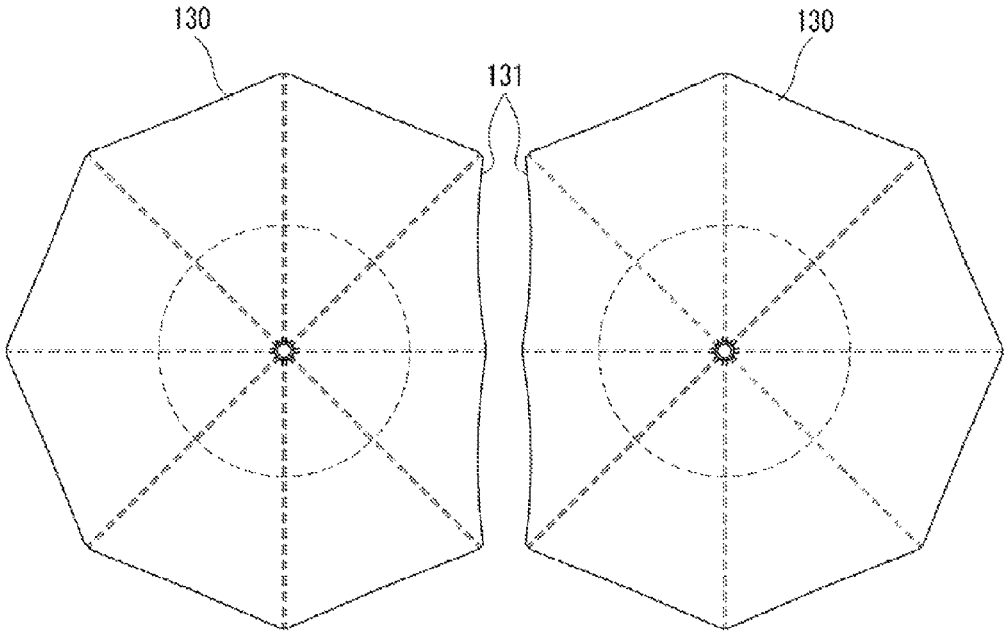
FIG. 6 is a plan view illustrating a floating membrane of the water shoe of FIG. 5.
Figure 7:
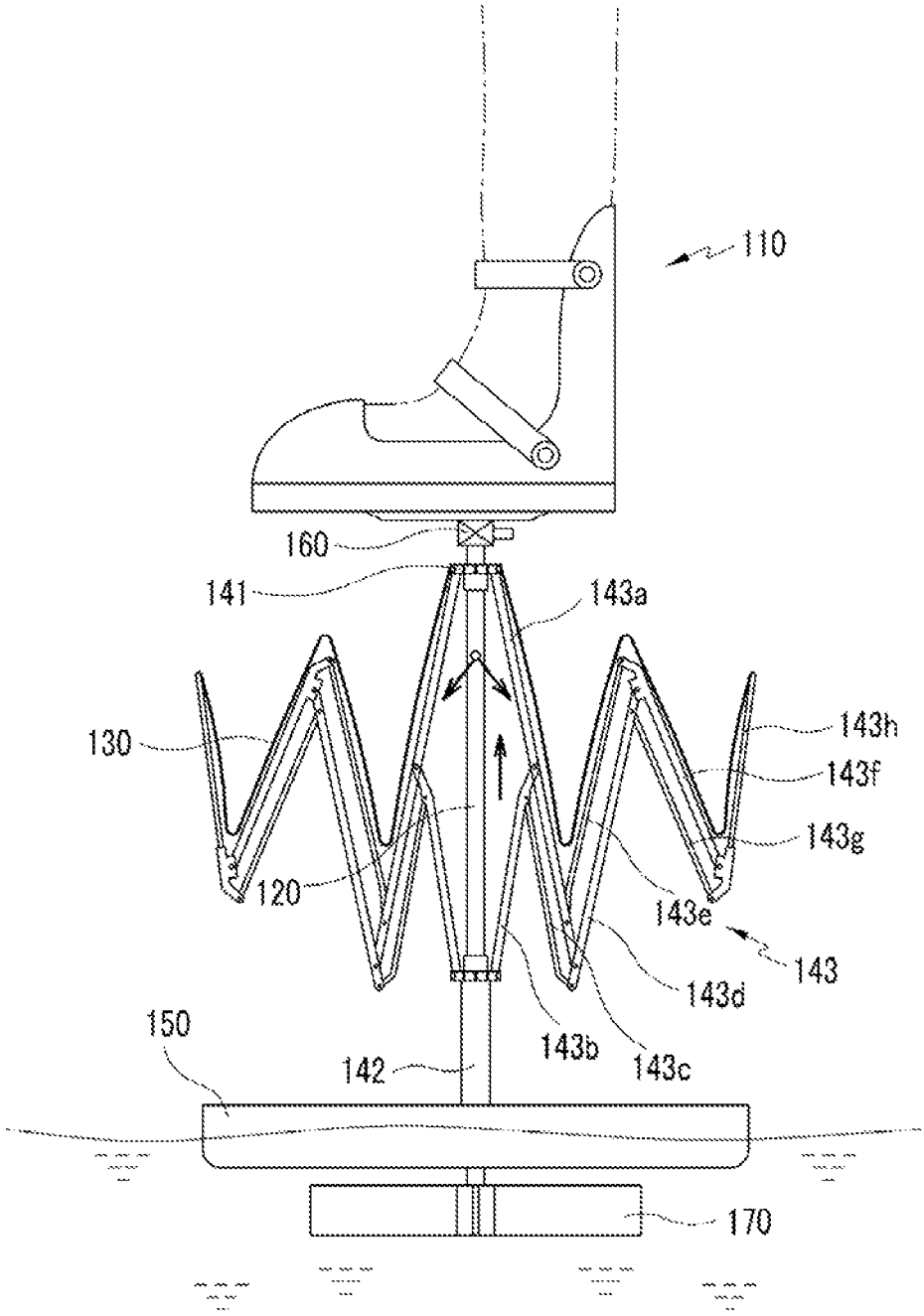
FIGS. 7 and 8 are cross-sectional views illustrating the water shoe of FIG. 5 being lifted up.
Figure 8:
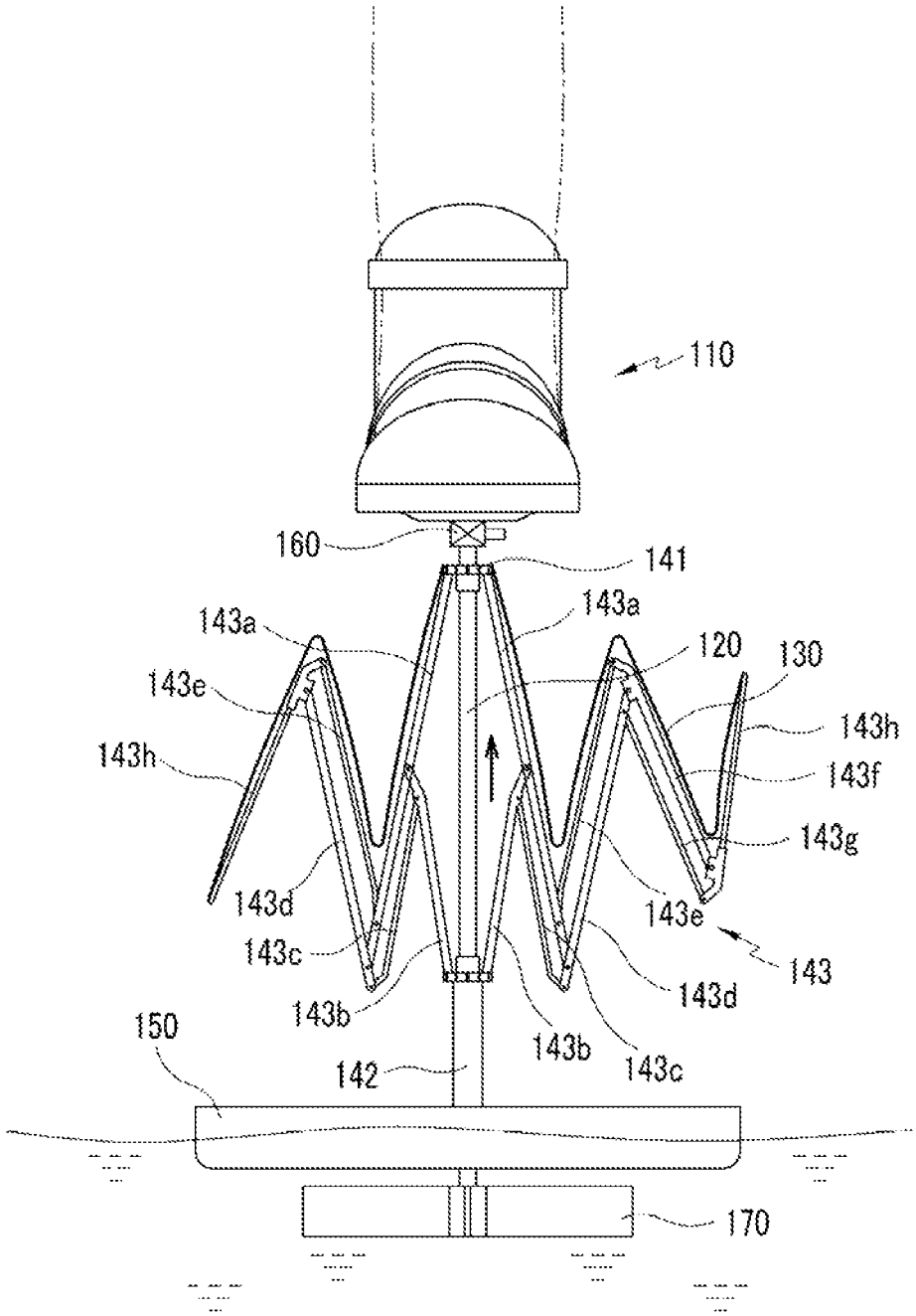

FIG. 5 is a cross-sectional view illustrating a water shoe according to another embodiment of the present invention, FIG. 6 is a plan view illustrating a floating membrane of the water shoe of FIG. 5, and FIGS. 7 and 8 are cross-sectional views illustrating the water shoe of FIG. 5 being lifted up.

The water shoe according to the current embodiment includes a foot fixing portion 110, a supporting bar 120, a floating membrane 130, a folding hinge portion 140, a float 150, a check valve 160, and a non-slip portion 170. Descriptions of the foot fixing portion 110, the supporting bar 120, the floating membrane 130, the float 150, the check valve 160, and the non-slip portion 170 are the same as in the descriptions of the first embodiment, and thus are omitted herein.

The folding hinge portion 140 is coupled with the floating membrane 130 to support the floating membrane 130 such that the floating membrane 130 may be folded or unfolded. The folding hinge portion 140 includes a fixing unit 141 fixed to an upper end of the supporting bar 120, a slider 142 disposed at the supporting bar 120 in an elevatable manner with a lower end of the slider 142 fixed to the float 150, and a plurality of floating membrane supporting members 143 hinged-connected to the fixing unit 141 and the slider 142 to support the floating membrane 130. The floating membrane supporting members 143 are coupled with one another in a radial shape on a bottom surface of the floating membrane 130.

Described hereinafter is a structure of the floating membrane supporting members 143. One side of the crosspiece 143*b* is coupled with the slider 142 coupled in a slidable manner with the supporting bar 120, and the other side of the crosspiece 143*b* is hinge-connected by a rivet to a middle portion of the first supporting rib 143*a*. One side of the first supporting rib 143*a* is coupled with the fixing unit 141 fixed to the upper end of the supporting bar 120. One side of the auxiliary rib 143*c* is hinge-connected by a rivet to the other side of the crosspiece 143*b*, and each of tips of the auxiliary rib 143*c* and the first supporting rib 143*a* are hinge-connected by a rivet to a side of the second supporting rib 143*d*. One side of the first auxiliary middle rib 143*e* is hinge-connected by a rivet to the other side of the first supporting rib 143*a*, and one side of the third supporting rib 143*f* is hinge-connected by a rivet to the other sides of the second supporting rib 143*d* and the first auxiliary middle rib 143*e*. One side of the second auxiliary middle rib 143*g* is hinge-connected by a rivet to the other side of the second supporting rib 143*d*, and the fourth supporting rib 143*h* is hinge-connected by a rivet to the other sides of the third supporting rib 143*f* and the second auxiliary middle rib 143*g*. Therefore, the supporting ribs 143*a*, 143*d*, 143*f*, and 143*h* may be folded in a four-stage manner to form each of the longer floating membrane supporting members 143 constituting the folding hinge portion 140.

Meanwhile, as illustrated in FIG. 8, the floating membrane supporting member 143 disposed at a side 131 where the floating membrane 130 is cut may not include the third supporting rib 143*f* and the second auxiliary middle rib 143*g*. Here, the fourth supporting rib 143*h* is hinge-connected to the second supporting rib 143*d* and the first auxiliary middle rib 143*e*. Therefore, the supporting ribs 143*a*, 143*d*, and 143*h* may be folded in a three-stage manner to form the shorter floating membrane supporting member 143 constituting the folding hinge portion 140.

When the supporting bar 120 descends and the slider 142 ascends relatively as illustrated in FIG. 5, the floating membrane supporting members 143 are unfolded in an arch shape. On the contrary, when the supporting bar 120 ascends and the slider 142 descends relatively as illustrated in FIGS. 7 and 8, the floating membrane supporting members 143 are folded in a multistage manner.

In other words, when the foot fixing portion 110 is pressed with a foot fixed to the foot fixing portion 110, the floating membrane supporting members 143 are unfolded in an arch shape and a rim of the floating membrane 130 comes into contact with a water surface as illustrated in FIG. 5. When the foot fixing portion 110 is lifted up with the foot fixed to the foot fixing portion 110 as illustrated in FIGS. 7 and 8, the floating membrane supporting members 143 are folded in a multistage manner, and the rim is separated from the water surface. When the floating membrane supporting members 143 are unfolded or folded, the floating membrane 130 coupled with the floating membrane supporting members 143 are unfolded or folded correspondingly.

Therefore, less energy is consumed when the rim is separated from the water surface with the floating membrane 130 folded as illustrated in the current embodiment than with the floating membrane 130 unfolded. In other words, when the floating membrane 130 is folded in a multistage manner, the area of the floating membrane 130 coming into contact with the water surface decreases, and the water shoe may be lifted up more easily.

Hereinafter, operation of the water shoe of the current embodiment is described in detail. Descriptions of the components except for the folding hinge portion 140 are the same as in the descriptions of the first embodiment, and thus are omitted herein.

When the supporting bar 120 is pressed with a foot fixed to the foot fixing portion 110 as illustrated in FIG. 5, the slider 142 ascends relatively due to the float 150 afloat, and the floating membrane supporting members 143 are unfolded.

When the foot fixing portion 110 is lifted up as illustrated in FIGS. 7 and 8, the supporting bar 120 ascends, and the slider 142 descends due to the weight of the float 150 afloat and the weight of the slider 142 afloat. In this case, the floating membrane supporting members 143 supporting the floating membrane 130 are folded in a multistage manner, and the floating membrane 130 coupled with the floating membrane supporting members 143 are lifted up in a folded state. Therefore, the area of the floating membrane 130 coming into contact with the water surface decreases, and the water shoe may be lifted up more easily.

Since the floating membrane supporting members 143 coupled with the bottom surface of the floating membrane 130 to support the floating membrane 130 are folded in a multistage manner, the floating membrane 130 is folded correspondingly to the floating membrane supporting members 143 when the foot fixing portion 110 is lifted up, and the area of the floating membrane 130 coming into contact with the water surface decreases. Thus, the water shoe according to the current embodiment as described above may facilitate walking on a water surface.

Figure 9:
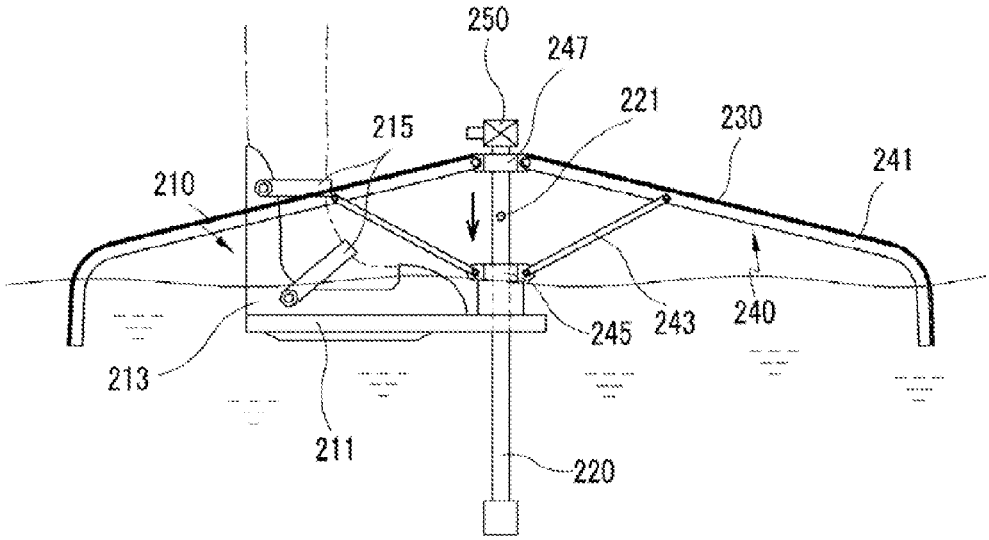
FIG. 9 is a cross-sectional view illustrating a water shoe according to another embodiment of the present invention.
Figure 10:
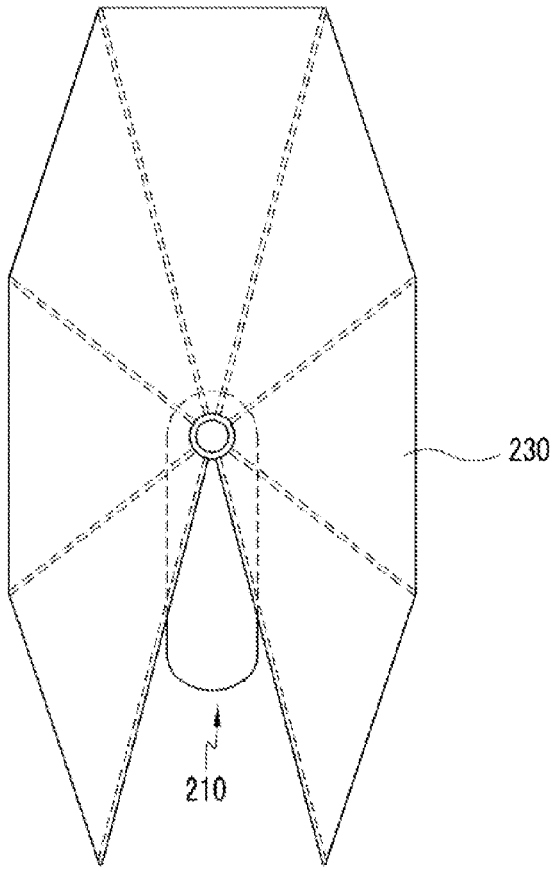
FIG. 10 is a plan view illustrating a floating membrane of the water shoe of FIG. 9.
Figure 11:
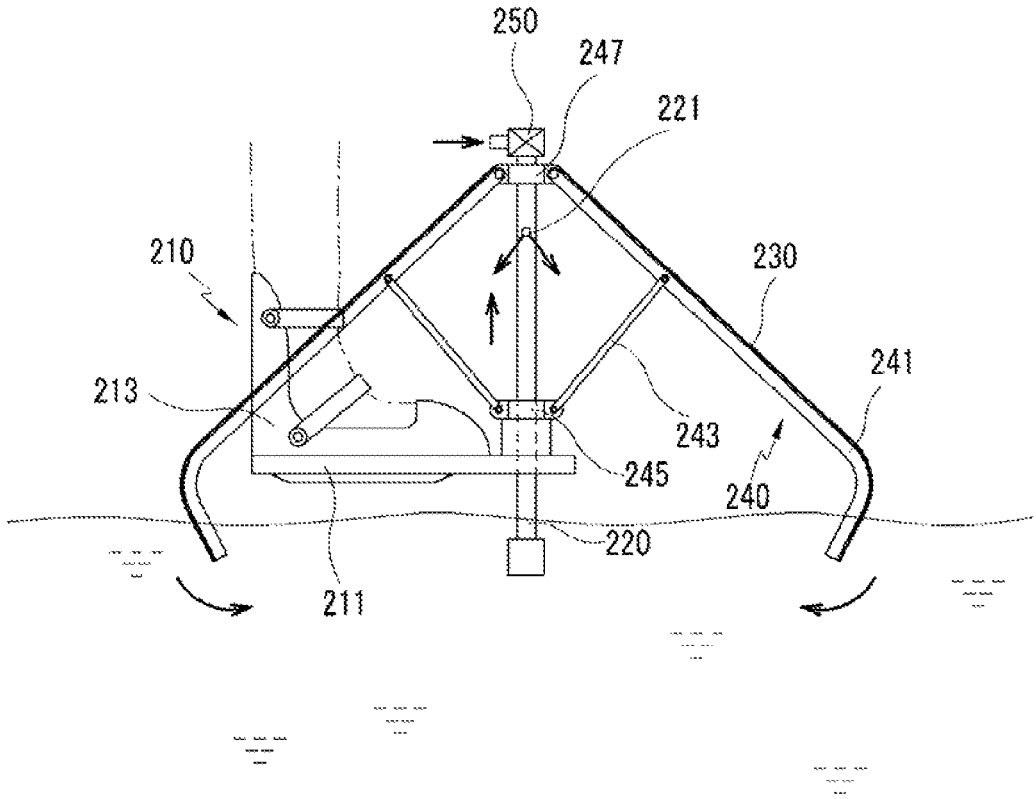
FIG. 11 is a cross-sectional view illustrating the water shoe of FIG. 9 being lifted up.

FIG. 9 is a cross-sectional view illustrating a water shoe according to another embodiment of the present invention, FIG. 10 is a plan view illustrating a floating membrane of the water shoe of FIG. 9, and FIG. 11 is a cross-sectional view illustrating the water shoe of FIG. 9 being lifted up.

The water shoe according to the current embodiment includes a foot fixing portion 210, a supporting bar 220, a floating membrane 230, a folding hinge portion 240, and a check valve 250. Descriptions of the check valve 250 are the same as in the descriptions of the first embodiment, and thus are omitted herein.

The foot fixing portion 210 includes a footplate 211 configured to support a sole of a shoe or a sole of a foot, a binder 213 fixed to an upper surface of the footplate 211 to support front and rear portions of a shoe or a foot, and a fastening band 215 fixed to the binder 213. Here, the fastening band 215 may fasten an ankle stably by being coupled with a turnbuckle or a hook. A structure of the foot fixing portion 210 may vary as long as the foot fixing portion 210 fixes a shoe or a foot stably.

The supporting bar 220 is coupled vertically in a sliding manner with a front portion of the foot plate 211 of the foot fixing portion 210 to support the floating membrane 230 and the folding hinge portion 240. The supporting bar 220 has a pole shape or a polygonal bar shape so that an air passage may be formed in the supporting bar 220. An air passage (not illustrated) is formed in the supporting bar 220, and a vent hole 221 for ventilation is formed on a side surface of the supporting bar 220.

The floating membrane 230 is configured to provide buoyancy to the water shoe when the floating membrane 230 comes into contact with a water surface. The floating membrane 230 may be folded toward or unfolded from the supporting bar 220 with the supporting bar 220 functioning as a pivot shaft, and supported by the folding hinge portion 240. The floating membrane 230 may be formed of a material having a hydrophobic property or coated with a hydrophobic substance so that water may be removed from a surface of the floating membrane 230 with speed.

Here, a rear portion of the floating membrane 230 may be cut as illustrated in FIG. 10. In other words, the rear portion of the floating membrane 230 may be cut so that a foot is not caught by the floating membrane 230 in walking with the foot fixed to the foot fixing portion 210.

The folding hinge portion 240 is coupled with the floating membrane 230 to support the floating membrane 230 such that the floating membrane 230 may be folded or unfolded. The folding hinge portion 240 includes a plurality of floating membrane supporting members 241 configured to support the floating membrane 230, a plurality of supporting ribs 243 configured to support the floating membrane supporting members 241, and a slider 245 configured to support the supporting ribs 243.

Here, upper ends of the floating membrane supporting members 241 are hinge-connected to a fixing unit 247 fixed to supporting bar 220. One ends of the supporting ribs 243 are hinge-connected to the floating membrane supporting members 241, and the other ends of the supporting ribs 243 are hinge-connected to the slider 245. Here, the slider 245 is fixed to the front portion of the footplate 211 of the foot fixing portion 210, and disposed at the supporting bar 200 in an elevatable manner. The floating membrane supporting members 241, the supporting ribs 243, the slider 245, and the fixing unit 247 have a three-bar link shape.

Hereinafter, operation of the water shoe of the current embodiment is described in detail.

Referring to FIG. 9, a foot is put in the foot fixing portion 210, and then the fastening band 215 is fastened. Here, the fastening band 215 allows the foot to be fixed stably to the binder 213.

When the foot fixing portion 210 is lifted up and then put down with the foot fixed to the foot fixing portion 210, the foot fixing portion 210 and the slider 245 descend, the floating membrane supporting members 241 are unfolded, and a bottom surface of the floating membrane 230 comes into contact with a water surface. In other words, when a weight of the foot affects the water shoe, the floating membrane 230 is unfolded by a pressure in a space between the floating membrane 230 and the water surface. When the floating membrane 230 is unfolded, the floating membrane supporting members 241 of the folding hinge portion 240 are unfolded in a radial shape.

Referring to FIG. 11, when the foot is lifted up for walking, the floating membrane 230 is lifted up toward an upper portion of the water surface. In this case, the space between the floating membrane 230 and the water surface expands gradually, and the pressure in the space decreases gradually.

The more the water shoe is lifted up, the closer the pressure in the space to atmospheric pressure. In this case, the floating membrane 230 is about to be detached from the water surface.

When the pressure in the space between the floating membrane 230 and the water surface becomes lower than atmospheric pressure, air flows into the space through the check valve 250. Then, the floating membrane 230 and the folding hinge portion 240 are folded slightly because of the air flown into the space. In this case, the pressure in the space becomes almost the same as atmospheric pressure, and the floating membrane 230 may be detached with ease from the water surface.

As described above, the check valve 250 provides air to the space between the floating membrane 230 and the water surface only when the floating membrane 230 is folded, and prevents the floating membrane 230 from functioning as a resister when the foot is lifted up. Therefore, the check valve 250 facilitates walking on a water surface.

As described above, the water shoe of the current embodiment of the present invention has a simple structure, and may be put to use in water leisure sports at an inexpensive cost. Further, the water shoe may be used even in a narrow area, without a motorboat, and almost unencumbered by weather conditions.

The water shoe of the present invention has the following effects.

As described above, the water shoe of the present invention has a simple structure, and may be put to use in water leisure sports at an inexpensive cost. Further, the water shoe may be used even in a narrow area, without a motor boat, and almost unencumbered by weather conditions.

In addition, the water shoe of the present invention may facilitate walking on a water surface since the floating membrane supporting members coupled with the bottom surface of the floating membrane to support the floating membrane are folded in a multistage manner, and the floating membrane is folded correspondingly to the floating membrane supporting members when the foot fixing portion 110 is lifted up so that the area of the floating membrane coming into contact with the water surface decreases.

In addition, the water shoe of the present invention enables walking and veering without slipping on a water surface since the non-slip portion is fixed to the lower end of the supporting bar.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A water shoe, comprising:

a foot fixing portion;

a supporting bar coupled with the foot fixing portion;

a floating membrane coupled with the supporting bar, wherein the floating membrane provides buoyancy to the water shoe when the floating membrane comes into contact with a water surface, the floating membrane being foldable toward and unfoldable from the supporting bar with the supporting bar functioning as a pivot shaft; and a folding hinge portion coupled with the floating membrane to fold and unfold the floating membrane.

2. The water shoe of claim 1, further comprising a check valve coupled with the supporting bar to provide external air to a space between the floating membrane and the water surface when the floating membrane is folded.

3. The water shoe of claim 2, wherein an air passage is formed in the supporting bar, and a vent hole for ventilation is formed on a side surface of the supporting bar.

4. The water shoe of claim 3, wherein the check valve prevents air from escaping outwards from the space between the floating membrane and the water surface while allowing external air to flow into the space between the floating membrane and the water surface.

5. The water shoe of claim 1, wherein a side of the floating membrane is cut.

6. The water shoe of claim 1, wherein the folding hinge portion comprises a slider disposed at the supporting bar in an elevatable manner, and a float disposed at the supporting bar in an elevatable manner to provide buoyancy is coupled with the slider.

7. The water shoe of claim 6, wherein the folding hinge portion comprises:

a plurality of floating membrane supporting members coupled with a bottom surface of the floating membrane to support the floating membrane;

a plurality of supporting ribs, one end of each of the supporting ribs being hinge-connected to each of the floating membrane supporting members;

the slider disposed at the supporting bar in a slidable manner, the other end of the each of the supporting ribs being hinged-connected to the slider to support the each of the supporting ribs; and a fixing unit fixed to the supporting bar, an upper portion of the each of the floating membrane supporting members being hinge-connected to the fixing unit.

8. The water shoe of claim 1, further comprising a non-slip portion fixed to a lower end of the supporting bar to prevent a foot from slipping on the water surface.

9. The water shoe of claim 8, wherein the non-slip portion has a cross shape.

10. The water shoe of claim 6, wherein the folding hinge portion comprises a plurality of floating membrane supporting members coupled with a bottom surface of the floating membrane in a radial shape, each of the floating membrane supporting members comprises a plurality of supporting ribs, and the supporting ribs are coupled with one another such that the supporting ribs are folded in a multistage manner.

11. The water shoe of claim 10, wherein the supporting ribs are unfolded when the supporting bar is pressed with a foot fixed to the foot fixing portion, the supporting ribs are folded in a multistage manner when the supporting bar is lifted up with a foot fixed to the foot fixing portion, and the floating membrane is unfolded or folded correspondingly when the supporting ribs are unfolded or folded.

12. The water shoe of claim 1, wherein the supporting bar passes through a front portion of the foot fixing portion vertically in a slidable manner.

13. The water shoe of claim 12, wherein a rear portion of the floating membrane is cut so that a foot is not caught by the floating membrane in walking with the foot fixed to the foot fixing portion.

14. The water shoe of claim 12, wherein the folding hinge portion comprises:

a plurality of floating membrane supporting members coupled with a bottom surface of the floating membrane to support the floating membrane;

a plurality of supporting ribs, one end of each of the supporting ribs being hinge-connected to each of the floating membrane supporting members;

a slider disposed at the supporting bar in an elevating manner, and fixed to the front portion of the foot fixing portion, the other end of the each of the supporting ribs being hinge-connected to the slider; and a fixing unit fixed to the supporting bar, an upper portion of the each of the floating membrane supporting members being hinge-connected to the fixing unit.

15. The water shoe of claim 13, wherein the folding hinge portion comprises:

a plurality of floating membrane supporting members coupled with a bottom surface of the floating membrane to support the floating membrane;

a plurality of supporting ribs, one end of each of the supporting ribs being hinge-connected to each of the floating membrane supporting members;

a slider disposed at the supporting bar in an elevatable manner, and fixed to the front portion of the foot fixing portion, the other end of the each of the supporting ribs being hinge-connected to the slider; and a fixing unit fixed to the supporting bar, an upper portion of the each of the floating membrane supporting members being hinge-connected to the fixing unit.

* * * * *